United States Patent [19]

Tyler et al.

[11] 4,309,270

[45] Jan. 5, 1982

[54] FLASH PYROLYSIS OF AGGLOMERATING COAL

[75] Inventors: Ralph J. Tyler, North Epping; Ian W. Smith, Avalon Beach; James H. Edwards, East Ryde, all of Australia

[73] Assignee: Commonwealth Scientific and Industrial Research Organization, Australia

[21] Appl. No.: 47,665

[22] Filed: Jun. 12, 1979

[30] Foreign Application Priority Data

Jun. 13, 1978 [AU] Australia ..... PD4702

[51] Int. Cl.[3] ..... C10G 1/00; C10B 47/24

[52] U.S. Cl. ..... 208/8 R; 208/11 R; 201/2.5; 201/31

[58] Field of Search ..... 201/2.5, 31; 208/8 R, 208/11 R

[56] References Cited

U.S. PATENT DOCUMENTS

| | | | |
|---|---|---|---|
| 2,360,787 | 10/1944 | Murphree et al. | 260/449.6 |
| 2,468,508 | 4/1949 | Munday | 260/449.6 |
| 2,553,398 | 5/1951 | Atevell | 260/449.6 |
| 2,560,478 | 7/1951 | Roetheli | 201/28 X |
| 2,595,365 | 5/1952 | Odell et al. | 201/31 X |
| 2,620,313 | 12/1952 | Odell | 252/417 |
| 2,626,275 | 1/1953 | Sullivan | 260/449.6 |
| 2,627,499 | 2/1953 | Krebs | 201/31 X |
| 2,711,387 | 6/1955 | Matheson et al. | 201/31 |
| 3,070,515 | 12/1962 | Sylvander | 201/31 X |
| 3,117,064 | 1/1964 | Friedrich | 208/8 R X |
| 3,736,233 | 5/1973 | Sass et al. | 201/31 X |
| 4,064,018 | 12/1977 | Choi | 208/11 R X |
| 4,225,531 | 9/1980 | Jones et al. | 201/31 X |

FOREIGN PATENT DOCUMENTS

| | | | |
|---|---|---|---|
| 2910614 | 9/1979 | Fed. Rep. of Germany | 201/31 |

*Primary Examiner*—Delbert E. Gantz
*Assistant Examiner*—William G. Wright
*Attorney, Agent, or Firm*—Sughrue, Mion, Zinn, Macpeak & Seas

[57] ABSTRACT

A technique is described which enables agglomerating coals (caking coals) to be flash pyrolyzed in a fluidized-bed reactor without agglomerates forming in the fluidized-bed. The technique requires the inert particles of the fluidized-bed to be coarser and denser than the particulate coal being pyrolyzed. With this arrangement the momentum of the inert particles in the fluidized-bed is believed to destroy the agglomerates as they form.

4 Claims, 1 Drawing Figure

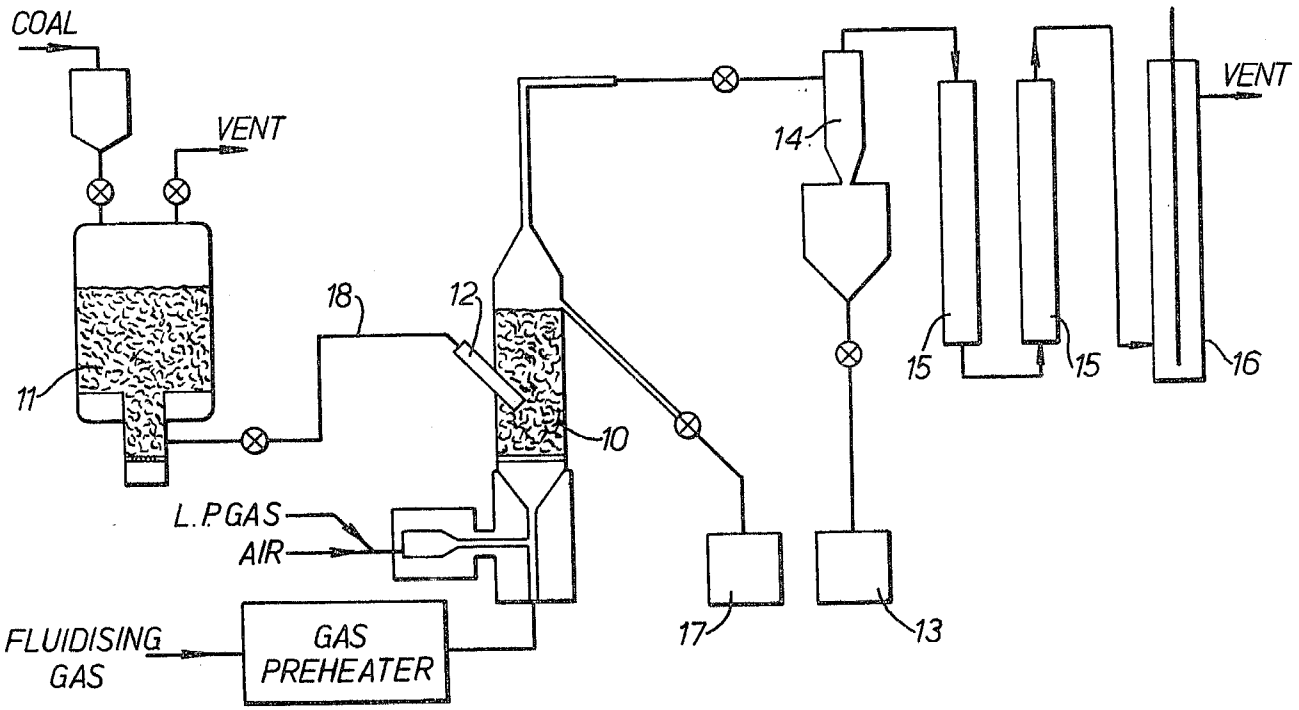
VENT
16
15
15
13
14
17
10
12
18
VENT
COAL
11
L.P.GAS
AIR
GAS PREHEATER
FLUIDISING GAS

FLASH PYROLYSIS OF AGGLOMERATING COAL

This invention concerns the flash pyrolysis of agglomerating coals to produce gaseous, liquid and solid decomposition products. More particularly, it concerns a technique whereby agglomerating coals can be flash pyrolysed in a fluidised bed reactor.

Pyrolysis (also referred to as carbonisation) of coal and other carbonaceous solids (for example, oil shale) is a well-established technique. It is the heating of carbonaceous material to temperatures at which thermal decomposition occurs with the formation of condensible organic liquids (normally referred to as tars and light oils), non-condensible gases and a solid residue (normally referred to as char). It has been a traditional source of benzole and other liquid hydrocarbons. The tars produced by the process can be further refined with hydrogen to produce a range of liquid fuels.

The total yields of tar and liquid hydrocarbons from pyrolysis of the coal or other carbonaceous material are markedly influenced by pyrolysis conditions such as heating rate, temperature and residence times of the liberated volatiles and coal particles in the pyrolysis zone. When pyrolysis of coal has been used in the production of metallurgical coke and town gas, fixed-bed, slow heating retorts have been used and the tar and liquid hydrocarbons were considered as by-products. The yields of liquids from these retorts were low, normally being only five to ten percent by weight of the coal processed. But if the coal is subjected to rapid or "flash" pyrolysis followed by rapid quenching of the volatile products, the yields of liquids from the process are maximised and secondary decomposition of the tar product is minimised. This concept of flash pyrolysis has been readily accepted as a very promising carbonisation technique for production of oil from coal.

The essential requirements for flash pyrolysis are:

(i) Very high heating rates for the coal particles (typically $10^4$ ° C. per second or more) and (ii) low residence time of the volatiles in the pyrolysis zone (i.e., rapid removal and quenching of volatiles).

These conditions are most readily obtained by the processing of finely divided coal particles in either fluidised-bed or entrained-flow reactors. Using such equipments, it has been shown that, experimentally, it is possible to obtain tar yields of up to thirty to thirty-five percent of the dry-ash-free (daf) coal (depending on the type of coal used).

Problems are experienced when agglomerating coals (also called caking coals) are used in flash pyrolysers because it is necessary to take the coal particles through the temperature range at which they become plastic, and in which stage the coal particles tend to agglomerate, before good yields of volatiles are obtained. With agglomerating coal, severe build-up of agglomerated char can occur in the pyrolyser or the product outlet lines, or in both. These agglomerated char deposits can adversely affect the operating characteristics of the pyrolyser and can ultimately render the process inoperable.

Various techniques have been proposed for overcoming or reducing the problems experienced with agglomerating coals. They include:

(a) staged heating of the carbonaceous material (for example, the COED Process);

(b) mechanical mixing of the carbonaceous material (for example, the Lurgi-Ruhrgas Process);

(c) mixing caking carbonaceous material with non-agglomerating materials (such as hot char) and hot inert gas in turbulent flow (for example, the process described by Sass et al in U.S. Pat. No. 3,736,233 and the Westinghouse draft-tube gasifier);

(d) mild oxidation and dilution of the carbonaceous material with char produced by pyrolysis (see the paper by Lang et al in "Industrial Engineering Chemistry" Vol. 49, p. 335, 1957); and (e) oxidation without external recycle of char (for example, the Parry Process).

Processes have also been developed for either substantially or totally destroying the agglomeration properties of caking carbonaceous materials by mild oxidative pre-treatment, using oxygen or other oxidising gases, either:

(a) at temperatures below the plastic range of the carbonaceous material (for example, the process of Rotheli, described in U.S. Pat. No. 2,560,478), or (b) at temperatures within the plastic range of the carbonaceous material (for example, Sylvander's process, described in U.S. Pat. No. 3,070,515).

These techniques for handling agglomerating coals all have one or more of the following disadvantages:

(1) An increased complexity of the reactor system. Note, for example, the multi-staged reactor system of the COED process, where the stronger the agglomerating properties of the coal, the greater is the number of individual reactor stages required to handle the coal without agglomeration. (The COED process is described in the recent paper by R. C. Merrill et al, entitled "Clean Fuels from Eastern Coals by COED", which appeared in "Coal Processing Technology", Volume 2, pages 88–93, 1975.)

(2) Mechanical problems associated with operating the pyrolyser (for example, the Lurgi-Ruhrgas process, described by W. Peters in "Gluckauf", volume 112, pages 8–13, 1976).

(3) It is well known that treatment of the coal with oxygen (either in a separate pre-treatment reactor or by adding oxygen with the coal into the pyrolyser), results in a reduction in tar yield. This reduction of yield is significant because the oxygen preferentially oxidizes the volatile-forming constituents of the coal and the oxidation has to be carried out until the agglomerating properties of the coal are destroyed. It was pointed out by R. T. Struck et al in the paper "Small Continuous Unit for Fluidised-bed Carbonisation", which was published in "Industrial Engineering Chemistry, Process Design Development", Volume 6, pages 85–88, 1967, that tar yields from daf coal falls from 19.5% to about 13.5% when 6% of the coal is pre-oxidized.

(4) In the case of simple dilution of the agglomerating coal particles by mixing them with non-agglomerating solid material having a similar particle size range (for example, char), the quantity of recycle char required is excessively large when this material is derived from an external source, and internal recycling of char or other inert material introduces an additional hot surface which enhances the cracking reactions with a resultant loss in tar yield. Nevertheless, the Westinghouse draft tube gasifier, which uses the internal recycling of char, is probably the best of the known prior art technologies for controlling agglomeration.

The present invention is a technique which overcomes the agglomeration problems associated with the flash pyrolysis of caking coals by performing the flash pyrolysis in a fluidised-bed reactor in which the fluidised-bed is constituted of inert particles which are both coarser and denser than the particles of coal fed to the reactor. The same reactor can, of course, be used for the flash pyrolysis of non-agglomerating carbonaceous material. A convenient inert material for the fluidised-bed is sand, but other dense inert materials, such as alumina or refractory material in particulate form, may be used.

Using the present invention, there is no need for an oxidative treatment of the coal and maximum tar yields to be obtained by flash pyrolysis can be realised in a single reactor, whilst eliminating or controlling agglomeration.

Thus, according to the present invention, a method of flash pyrolysis of coal comprises feeding a stream of coal in particulate form, suspended in an inert carrier, into a fluidised bed maintained at a temperature in the range of 400° C. to 1000° C., the fluidised bed being formed of inert particles of larger particulate size and density than coal feedstock.

Preferably the fluidised bed is maintained at a temperature in the range 500° C. to 800° C.

Typically, coal has a particle size at least one-sixth the size of the bed particles.

The precise mechanism by which agglomeration is controlled in the present invention has not been established, but it is believed that control is due to the momentum of the violently agitated inert particles in the fluidised-bed. The momentum of inert particles is thought to be sufficient to break up the plastic linkages between agglomerates as rapidly as they are formed within the bed. In this way, the inert bed material is not merely acting as a diluent. The dilution effect of the inert material might be assisting in the control of the agglomeration but it has been established that dilution alone is not sufficient to prevent the formation of agglomerates in the reactor which upset its operation.

Work carried out in experimental flash pyrolysers which demonstrates the effectiveness of the present invention, will now be described, with reference to the accompanying drawing which shows the layout of a fluidised bed reactor designed as a flash pyrolyser.

In this work, two reactors were used. Both reactors included a fluidised-bed pyrolyser 10 fed with a steady stream of pulverised coal from a continuously-weighed feeder 11. The pulverised coal was carried to the fluidised-bed using nitrogen as the conveying medium, and was injected into the fluidised-bed through a cooled injector probe 12. Within the fluidised bed 10, the coal was rapidly mixed with a metered and pre-heated gas stream. The gases leaving the reactor passed through systems for the recovery and determination of char and tar, and provision was made for the withdrawal of samples of the exhaust gas for analysis. Illustrated in the drawing are char receiver 13, cyclone 14, coolers 15 and an electrostatic precipitator (tar collector) 16, all of which are associated with the exhaust gas treatment. Receiver 17 collects the overflow from the top of the fluidised-bed.

The smaller of the two reactors had a fluidised-bed which was 28 mm in diameter. This reactor contained about 60 g of sand as the fluidised bed and processed coal at the rate of about 1 g per hour. The other (larger) reactor had a fluidised bed which was 152 mm in diameter, usually contained about 12 kg of sand particles, and was capable of processing 20 kg of coal per hour.

In operating the fluidised-bed reactors, hot gas was fed to the particulate sand beds, at sufficient velocity to fluidise the sand particles, until the bed temperature has been raised to the required pyrolysis temperature. A sample of coal, ground until it was all in particulate form with particles of a required diameter, was then suspended in nitrogen and fed continuously into the hot fluidised bed through cooled feed pipe 18. Within the fluidised bed, the coal particles were rapidly heated (within several milliseconds) to the reactor temperature and in doing so were 'flash pyrolysed' into volatiles and char.

In a reactor of this type operated in accordance with the present invention, due to the high gas velocity through the fluidised-bed 10, the volatiles are rapidly removed from the pyrolyser. If the char does not agglomerate, most of it is entrained from the sand bed with the volatiles and combustion gas. Any excess material in the bed is collected from the reactor in receiver 17.

The char entrained by the volatiles/combustion gas mixture is removed from the exhaust gases in cyclone 14. The gas stream is then rapidly cooled in heat exchangers 15 to condense the tar produced in the pyrolysis reactions and to prevent further thermal cracking of the tar. Any tar not condensed in the heat exchangers 15 is collected by electrostatic precipitator 16. The total residence time of the volatiles at pyrolysis temperature is a maximum of several seconds; calculations indicate that it is typically about 1 second. Synthetic oil can be produced from the tar and further treatments can be used to recover other products from the cooled gas stream leaving the heat exchangers 15.

A series of experiments was performed with these reactors using Loy Yang coal, Millmerran coal and Liddell coal. Loy Yang coal is a non-agglomerating coal. It has a B.S. Swelling No (a form of "caking index") of about 0. Millmerran coal is a mildly agglomerating coal and has a B.S. Swelling No of 1. Liddell coal is strongly agglomerating, with a B.S. Swelling No of 4.5.

In all experiments performed with Loy Yang coal in both pyrolyers, no agglomeration difficulties occurred. In the smaller pyrolyser, the particles forming the fluidised bed had a size comparable to the size of the coal particles fed to it and both Millmerran coal and Liddell coal produced agglomerates. However, neither Millmerran coal nor Liddell coat produced agglomerates when flash pyrolysis of the coals was carried out in the larger reactor. Typical experiments are detailed in the following examples.

EXAMPLE 1

0.634 g of particulate Millmerran coal, having an average particle size of 90 microns was fed into the smaller fluidised-bed reactor at the rate of 5.2 g per hour. The fluidised-bed comprised 62 g of sand, having an average particle size of 128 microns. The reactor temperature was 602° C. The fluidising gas flow was 1.14 liters per minute at NTP (3.65 liters per minute at reactor temperature). During the experiment, the tar yield was 30.1 percent daf. The run was terminated due to bed agglomeration problems. The onset of agglomeration had been indicated by a decrease in reactor temperature as the bed de-fluidised. Subsequent inspection of the bed showed the presence of sand-char-sand agglomerates, with a number of particles of sand bound together by a small mass of char. 83 percent of the total char produced in the 7.3 minutes run remained in the bed as agglomerates.

EXAMPLE 2

0.396 g of Liddell coal, in the form of particles having an average size of 90 microns, was fed into the smaller pyrolyser during a run of 15.3 minutes. The fluidised bed of sand particles having an average diameter of 128 microns was maintained at a temperature of 600° C. The fluidising gas flow was 4.76 liters per minute at reactor temperature (1.49 liters per minute at NTP). The run was terminated due to agglomeration problems. Inspection of the bed after the run showed that sand-char-sand agglomerates, similar to those observed in Example 1, had been formed. 94 percent of the total char product had remained in the bed as agglomerates. The tar yield was 28.1 percent daf.

EXAMPLE 3

During a 3 hour run with the larger pyrolyser, 71 kg of the particulate Millmerran coal used in Example 1 were flash pyrolysed. The fluidised-bed of the reactor was maintained at 600° C. The sand particles of the fluidised-bed had an average size of 600 microns and the fluidising gas was supplied at the rate of 1,833 liters per minute at reactor temperature (34,400 liters per hour at NTP). The run was voluntarily terminated, the tar yield was 34 percent daf, and subsequent inspection of the bed showed that less than 1 percent of the char produced had been retained in the bed. There was no indication of agglomeration occurring. Almost all the char had been entrained in the exhaust gases of the pyrolyser as a free flowing powder.

EXAMPLE 4

In another run with the larger reactor, lasting 1.9 hours, 27 kg of the Liddell coal used in Example 2 were flash pyrolysed at 610° C. The fluidising gas was supplied at 1,570 liters per minute at reactor temperature (29,100 liters per hour at NTP). The run was terminated voluntarily, no blockages due to agglomeration having occurred, notwithstanding that about 70 percent of the char produced had been retained in the bed as a thin coating on individual sand grains. The coating had in no way impeded the fluidising capability of the bed, which had remained free-running throughout the experiment. There was no evidence of any sand-char-sand agglomeration of the type which had occurred when the same coal was pyrolysed in the smaller reactor (see Example 2).

Consideration of these and other experimental data indicates that agglomeration is prevented in the larger pyrolyser due to the much greater momentum of the inert particles. In the larger pyrolyser, the inert material is much coarser then the coal particles and the fluidising velocities are much higher than in the smaller pyrolyser (144 to 168 cm per second compared with 8.6 to 11.2 cm per second in the smaller pyrolyser).

An important point to note is that the agglomeration has been prevented without sacrificing the tar yield.

We claim:

1. A method of flash pyrolysis of coal comprising feeding a stream of coal, in particulate form and suspended in an inert carrier, into a fluidised-bed maintained at a temperature in the range 400° C. to 1000° C., the fluidised-bed being formed of inert particles of larger particulate size and density than the coal.

2. A method as defined in claim 1, in which the average size of the particles of coal is about one-sixth the average size of the inert fluidised-bed particles.

3. A method as defined in claim 2, in which the fluidised-bed particles are sand particles having an average diameter of about 600 microns.

4. A method as defined in claim 1, in which the fluidised-bed is maintained at a temperature in the range 500° C. to 800° C.

* * * * *